United States Patent [19]

Kenyon, 2nd

[11] Patent Number: 4,813,559

[45] Date of Patent: Mar. 21, 1989

[54] TAMPER-EVIDENT CONTAINER

[75] Inventor: Maynard A. Kenyon, 2nd, Hamilton Square, N.J.

[73] Assignee: General Foods Corporation, White Plains, N.Y.

[21] Appl. No.: 169,270

[22] Filed: Mar. 17, 1988

[51] Int. Cl.[4] ..... B65D 41/32

[52] U.S. Cl. ..... 215/230; 215/246; 215/365

[58] Field of Search ..... 215/230, 246, 365

[56] References Cited

U.S. PATENT DOCUMENTS

| | | | |
|---|---|---|---|
| 3,088,830 | 5/1963 | Graham . | |
| 3,235,112 | 2/1966 | Fillwalk et al. | 215/365 |
| 3,615,714 | 10/1971 | Nelson . | |
| 3,951,292 | 4/1976 | Amberg | 215/230 |
| 3,984,005 | 10/1976 | Amberg | 215/230 |
| 4,538,740 | 9/1985 | Petersen, Jr. | 215/246 |
| 4,540,101 | 9/1985 | Kutcher | 215/252 |
| 4,544,073 | 10/1985 | Willis | 215/246 |
| 4,724,973 | 2/1988 | Shah | 215/246 |

*Primary Examiner*—Donald F. Norton

*Attorney, Agent, or Firm*—Thomas R. Savoie; Daniel J. Donovan

[57] ABSTRACT

A container having a tamper evident closure structure. An open top container is closed by a removable cap which includes a skirt secured to the outside of the upper edge of the container. A shrink band encircles the container at the junction between the skirt and the container body. A label encircles the container with its upper portion overlapping and adhered to the shrink band such that removal of the shrink band tears away the upper portion of the label.

6 Claims, 1 Drawing Sheet

TAMPER-EVIDENT CONTAINER

FIELD OF THE INVENTION

This invention relates to containers, and more specifically it relates to an improved tamper evident closure structure for a container.

BACKGROUND OF THE INVENTION

It has been known heretofore to provide containers with a closure structure which provides evidence that tampering of the closure has occurred. Previous examples of known tamper evident closure structures include for example those shown in U.S. Pat. Nos. 3,088,830; 3,615,614; 3,951,292; 3,984,005; 4,538,740 and 4,540,101.

However, notwithstanding the existence of these known closures, there exists a continuing need for new and improved tamper evident closures for purposes of economy and also to extend the tamper evident concept to different kinds of containers.

SUMMARY OF THE INVENTION

It is the purpose of the present invention to provide a new and improved tamper evident container closure, and more specifically, it is a purpose of the present invention to provide such a new and improved tamper evident container closure for a type of container having an open top body and a cap having a skirt which fits thereover and is secured to the outside of the top of the open top body.

The present invention provides a tamper evident closure for a container of the type described which is relatively simple and hence economical to produce and yet highly effective in that it gives a clear visual indication that tampering has occurred.

The purpose of providing an economical and yet highly effective, highly-visible, tamper-evident closure is achieved by the fact that the present invention uniquely and economically interrelates together two known structural elements of a closure, namely (1) a shrink band, the basic purpose of which is to seal the container by being shrunk on the outside of the container so as to encompass the space between the container body and the skirt of the cap and (2) a conventional container label.

In accordance with a preferred embodiment of the present invention, a conventional shrink band is applied to the container such that it overlaps the junction between the container body and the outer, lowermost edge of the skirt of the cap, thereby encompassing the space therebetween, with said shrink band extending for a finite width above this juncture along the skirt of the cap and below this juncture along the body of the container. In combination therewith, a conventional label is applied to this container such that an upper portion thereof overlaps a bottom portion of the shrink band and is bonded thereto. Preferably the label includes a weakened line such as a line of perforations encircling the label just below the lower edge of the shrink band. Additional adhesive below this perforated line will then bond the remainder of the label to the body of the container.

The normal procedure for opening a container of this type would be to tear off the shrink band, which preferably has a cut area, tab or the like so as to facilitate tearing off of the shrink band. In accordance with the present invention, the torn off shrink band will then carry with it the upper portion of the label which is adhered thereto. If a line of perforations is provided around the label, tearing off the shrink band will automatically and quite neatly tear off the upper portion of the label which is adhered to the shrink band. Thereafter, the fact that the container has been opened is extremely visible because the upper portion of the label has been removed and obviously cannot possibly be replaced as neatly as its original condition. With the present invention, the visual impact of the tamper evidence can be enhanced by appropriate decorations on the label, for example a bright pattern, an important portion of which is located on the upper portion of the label which is bonded to the shrink band and hence torn off when the shrink band is removed.

Thus, it is an object of the present invention to provide a new and improved tamper evident container closure.

It is still another object of the present invention to provide a new and improved tamper evident container closure which includes a shrink band encircling the junction between the body of the container and the skirt of the cap closing the same and to adhere an upper portion of the container label to the shrink band.

It is still another object of the present invention to provide a container with a tamper evident closure comprising an open top container body, a cap which closes said top and includes a skirt portion secured to the upper outer edge of the container body, a shrink band encircling the junction between the skirt and the container body and wherein the upper portion of the label of the container is bonded to the outside of the shrink band, with the remainder of the label bonded to the body of the container body, and with perforated lines encircling the label below the shrink band so as to facilitate easy removal of the upper portion of the label with the shrink band.

These and other objects of the present invention will become apparent from the detailed description to follow.

BRIEF DESCRIPTION OF THE DRAWINGS

There follows a detailed description of a preferred embodiment of the present invention, to be read together with the accompanying drawings wherein.

DETAILED DESCRIPTION OF THE PREFERRED EMBODIMENT

Figure 1:
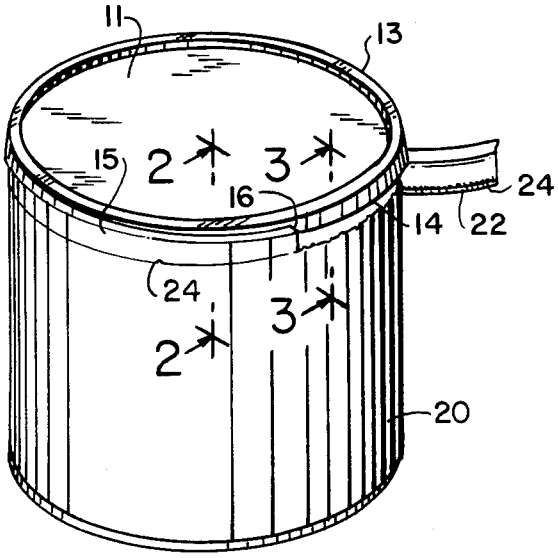
FIG. 1 is a perspective view of a container including the tamper evident closure of the present invention, with a portion of the label peeled away.
Figure 2:
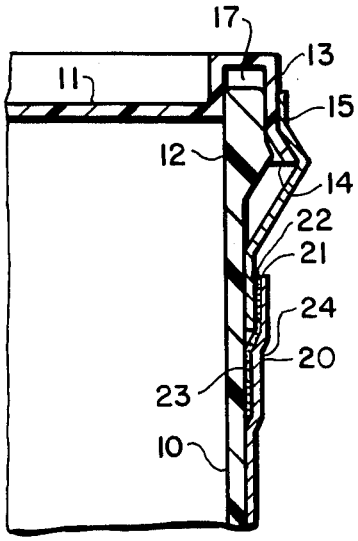
FIG. 2 is an enlarged partial cross-sectional view taken along line 2—2 of FIG. 1.
Figure 3:
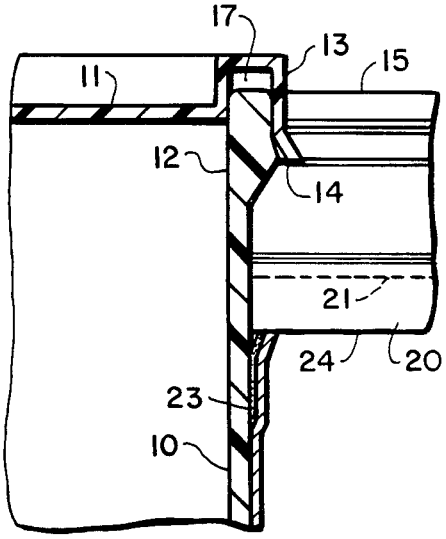
FIG. 3 is an enlarged partial cross-sectional view taken along line 3—3 of FIG. 1.

Referring now to the figures, like elements are represented by like numerals throughout the two views.

The tamper evident closure structure of the present invention is illustrated on a canister type jar, i.e., a jar of the type having a generally cylindrical open top body 10 which is closed by a cap 11. The cap 11 includes a skirt 13 which turns down over the outside of the container body 10 and which functions to secure the cap to the open end. As shown, skirt 13 terminates at its lower, outer edge in the form of a flared out edge 14.

As shown, cap 11 is secured to the open end of the container body by a friction seal which takes the form of a rim 12 which is received in a U-shaped channel 17.

Rim 12 will have an outer diameter which is greater than that of container body 10. The rim and channel may be shaped to provide means for the cap to lock or snap onto the rim. This arrangement as well as numerous modifications thereof are well-known in the art. Alternatively it would be possible to utilize this invention with a cap which is secured to the container by means of threads.

This invention is particularly suited for use in conjunction with reclosure caps (i.e., caps which can be removed from and replaced on the container). The use of a flexible, snap-on plastic lid having a flared skirt is shown as a preferred embodiment, but this invention is not limited thereto or based thereon.

As is known per se, the integrity of the seal formed between rim 12 and the receiving channel 17 is enhanced by securing over the juncture between the skirt 13 and the body portion 10 a shrink band 15. The band is positioned on the container and subsequently shrunk in place thereon. Shrink band 15 can be positioned below the top of cap 11; this will result in a more attractive appearance than if the shrink band were to extend onto the top surface of the cap. Shrink band 15 can be made to more firmly grip the lid skirt, if the skirt is flared as shown in the drawings, or otherwise possesses on or more external projections.

The materials and procedures for achieving shrink bands are well known in the art. Examples are shown in three of the above mentioned United States patents, namely U.S. Pat. Nos. 3,951,292; 3,984,005 and 4,538,740. Hence, the details of the shrink band itself need not be discussed in greater detail. Preferably the shrink band also has a starting notch 16 which one can easily grab to initiate tearing of the shrink band.

The container body includes a conventional label 20, for example a paper label which preferably but not necessarily completely encircles the container. The upper edge 21 of the paper label is located well above the lower edge of the shrink band so as to provide a substantial width of overlap of the paper label and the shrink band, completely around the periphery of the container. A band of adhesive 22 extends around the container, preferably 360° around the container, in the vicinity of the overlap between the label and the shrink band so as to bond this overlap portion of the paper label to the shrink band. Additional adhesive material such as a band of adhesive material 23 would be provided below the shrink band for bonding the remainder of the paper label to the container body 10.

The label preferably includes a weakened portion 24, preferably a line of perforations, for example six perforations to the inch. In a preferred arrangement, the top of the label 20 is located one quarter of an inch below the lower outer edge of the skirt 13 and the width of the overlap between the label 20 and the shrink band 15 would be on the order of three eighths of an inch.

In use, in order to open the container, one would engage the shrink band in the vicinity of the notch 16 and tear around the container to remove the shrink band. As the tear moved downwardly to the bottom of the shrink band, it would of course also tear the upper portion of the label, which tear would naturally continue downwardly toward the bottom of the shrink band. The tear would naturally seek to continue downwardly. If the perforated line 24 were not present, the tear would no doubt continue along an irregular path removing an unpredictable portion of the upper portion of the paper label. This in and of itself would be operative in that the torn away portion would be visible and would indicate that the container has been opened. However, for aesthetic purposes, it is desirable that the container retain a neat and clean appearance after the cap has been removed. For this purpose, the perforated line 24 is provided and its purpose would be to intercept the tear as it moves downwardly from the shrink band and divert it along a neat horizontal path completely around the container. While a clean tear along line 24 might provide less of a visual impact than an irregular tear, a strong visual impact can be achieved by providing the paper label with a bright pattern, a prominent portion of which crosses the perforated line 24 so that after removal of the shrink band and the upper portion of the label above the perforated line 24, the visual impact of a pattern which is clearly interrupted at the new upper edge of the label formed by line 24 would provide immediate and clear visual evidence of a tamper.

Although the invention has been described in considerable detail with respect to a preferred embodiment, it will be apparent that the invention is capable of numerous modifications and variations apparent to those skilled in the art without departing from the spirit and scope of the invention.

I claim:

1. A container having a tamper-evident closure structure, comprising:

(a) an open top body having an upper edge;

(b) a removable cap covering the top of the body and having a skirt, and cap being secured to the open end of the body;

(c) a shrink band encircling the container at the junction of the skirt and body, covering portions of the skirt and body adjacent the said junction;

(d) a label completely encircling the body, an entire 360° line of an upper portion of the label covering and bonded to a lower portion of the shrink band which covers the body, said label including a weakened portion encircling the label just below the lower edge of the shrink band; and (e) additional adhesive material bonding that portion of the label below the upper portion to the body, whereby removal of the shrink band will also separate the upper portion of the label from the remainder of the label.

2. A container according to claim 1 wherein the weakened portion comprises a perforated line.

3. A container according to claim 1, said label being a paper label.

4. A closed container having a generally cylindrical body and a removable reclosure cap which covers the container, said cap having a skirt and said cap being secured to an open end of the container body, a shrink band encircling the container, covering the skirt and extending upwardly along the skirt and downwardly along the body, a label of a material which tears more easily than the material of the shrink band, the upper portion of the label being adhesively bonded to a lower portion of the shrink band, and a line of perforations formed in the label just below the lower edge of the shrink band, whereby removal of the shrink band necessarily also removes therewith the upper portion of the label.

5. A closed container according to claim 4, including a 360° line of adhesive material bonding the upper portion of the label to the lower portion of the shrink band, and including additional adhesive material bonding the remainder of the label, below the shrink band, to the body of the container.

6. A closed container according to claim 5 wherein the removable cap is secured to the container body by means of a beaded rim on the container body being received in a U-shaped channel on the cap.

* * * * *